US010161191B2

(12) United States Patent
Grable

(10) Patent No.: US 10,161,191 B2
(45) Date of Patent: Dec. 25, 2018

(54) ENHANCED PLASTERING EFFECT IN BOREHOLE DRILLING

(71) Applicant: Halliburton Energy Services, Inc., Houston, TX (US)

(72) Inventor: Jeffery L. Grable, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 354 days.

(21) Appl. No.: 14/427,300

(22) PCT Filed: Oct. 30, 2012

(86) PCT No.: PCT/US2012/062623
§ 371 (c)(1),
(2) Date: Mar. 10, 2015

(87) PCT Pub. No.: WO2014/070148
PCT Pub. Date: May 8, 2014

(65) Prior Publication Data

US 2015/0240567 A1 Aug. 27, 2015

(51) Int. Cl.
*E21B 33/138* (2006.01)
*E21B 12/00* (2006.01)
*E21B 7/00* (2006.01)

(52) U.S. Cl.
CPC ..... *E21B 12/00* (2013.01); *E21B 7/00* (2013.01); *E21B 33/138* (2013.01)

(58) Field of Classification Search
CPC ..... E21B 12/00; E21B 7/00; E21B 33/138
(Continued)

(56) References Cited

U.S. PATENT DOCUMENTS 2,776,111 A * 1/1957 Vance ..... E21B 17/1078 166/287
2003/0098181 A1 5/2003 Aronstam et al.
(Continued)

FOREIGN PATENT DOCUMENTS

GB 2476381 6/2011
SU 362127 12/1972
(Continued)

OTHER PUBLICATIONS

International Search Report and Written Opinion of PCT Application No. PCT/US2012/062623 dated Apr. 25, 2013: pp. 1-14.

*Primary Examiner* — Taras P Bemko
(74) *Attorney, Agent, or Firm* — Chamberlain Hrdlicka

(57) ABSTRACT

A method of drilling a borehole can include chopping drill cuttings with a drilling tool connected in a drill string, the tool receiving the drill cuttings from a drill bit, and then forcing the chopped cuttings against a borehole wall. A well system can include a drilling tool which chops drill cuttings, and another drilling tool which forces the chopped drill cuttings against a borehole wall. Another method of drilling a borehole can include chopping drill cuttings with a drilling tool connected in a drill string, and then forcing the chopped drill cuttings against a wall of the borehole with another drilling tool connected in the drill string. Another drilling system can include a drilling tool connected in a drill string, the tool including at least one device which decreases an average size of drill cuttings between an outer housing and an inner mandrel.

26 Claims, 5 Drawing Sheets

(58) Field of Classification Search
USPC ..... 175/57
See application file for complete search history.

(56) References Cited

U.S. PATENT DOCUMENTS

| | | | |
|---|---|---|---|
| 2004/0154805 | A1 | 8/2004 | Fontana et al. |
| 2008/0277167 | A1 | 11/2008 | Viel et al. |
| 2010/0155067 | A1 | 6/2010 | Tunget |
| 2010/0175924 | A1 | 7/2010 | Bailey et al. |
| 2010/0300760 | A1 | 12/2010 | Beardmore et al. |

FOREIGN PATENT DOCUMENTS

| | | |
|---|---|---|
| SU | 1350328 | 11/1987 |
| SU | 1798477 | 2/1993 |

* cited by examiner

ENHANCED PLASTERING EFFECT IN BOREHOLE DRILLING

TECHNICAL FIELD

This disclosure relates generally to borehole drilling and, in one example described below, more particularly provides for enhancing a "plastering" effect during borehole drilling.

BACKGROUND

A "plastering" or "smear" effect is well known to occur in drilling operations (such as, casing while drilling operations, etc.). Drill cuttings pulverized and emulsified between a drill string and a borehole wall become "plastered" against the borehole wall by the drill string, thereby enhancing a stability and impermeability of the borehole wall.

It would, therefore be beneficial to be able to increase or otherwise enhance the plastering effect, for example, to provide increased borehole wall stability and impermeability.

DETAILED DESCRIPTION

Figure 1:
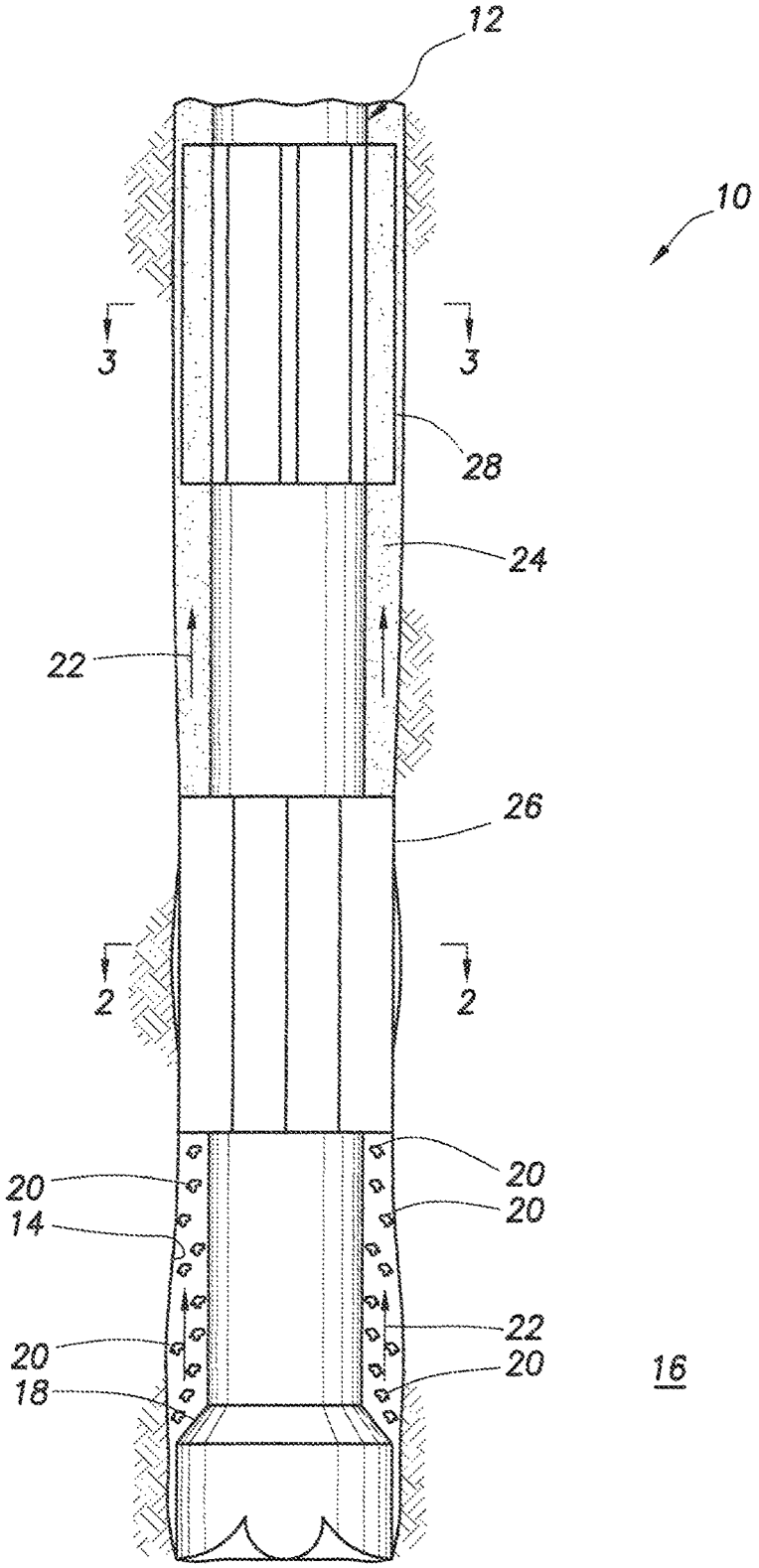
FIG. 1 is a representative partially cross-sectional view of a well drilling system and associated method which can embody principles of this disclosure.

Representatively illustrated in FIG. 1 is a well drilling system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a drill string 12 is being used to drill a borehole 14 into or through an earth formation 16. For this purpose, the drill string 12 includes a drill bit 18.

The drill bit 18 cuts or otherwise penetrates the formation 16, thereby producing drill cuttings 20. The drill cuttings 20 are suspended by a drilling fluid 22 which flows through an annulus 24 formed radially between the drill string 12 and a wall of the borehole 14.

In this example, the drill string 12 also includes a drilling tool 26 which receives the drill cuttings 20 from the drill bit 18. The drilling tool 26 chops, cuts, slices, pulverizes or otherwise decreases an average size of the drill cuttings 20 as they flow with the fluid 22 through the tool. In some examples, the drill cuttings 20 may become emulsified with the drilling fluid 22 by the drilling tool 26.

In this manner, the drill cuttings 20 are made more suitable for plastering against the wall of the borehole 14 by another drilling tool 28. The drilling tool 28 receives the chopped, cut, sliced, pulverized and/or emulsified drill cuttings 20 from the tool 26 and forces the diminished size cuttings against the borehole wall, thereby producing the plastering effect.

Figure 2:
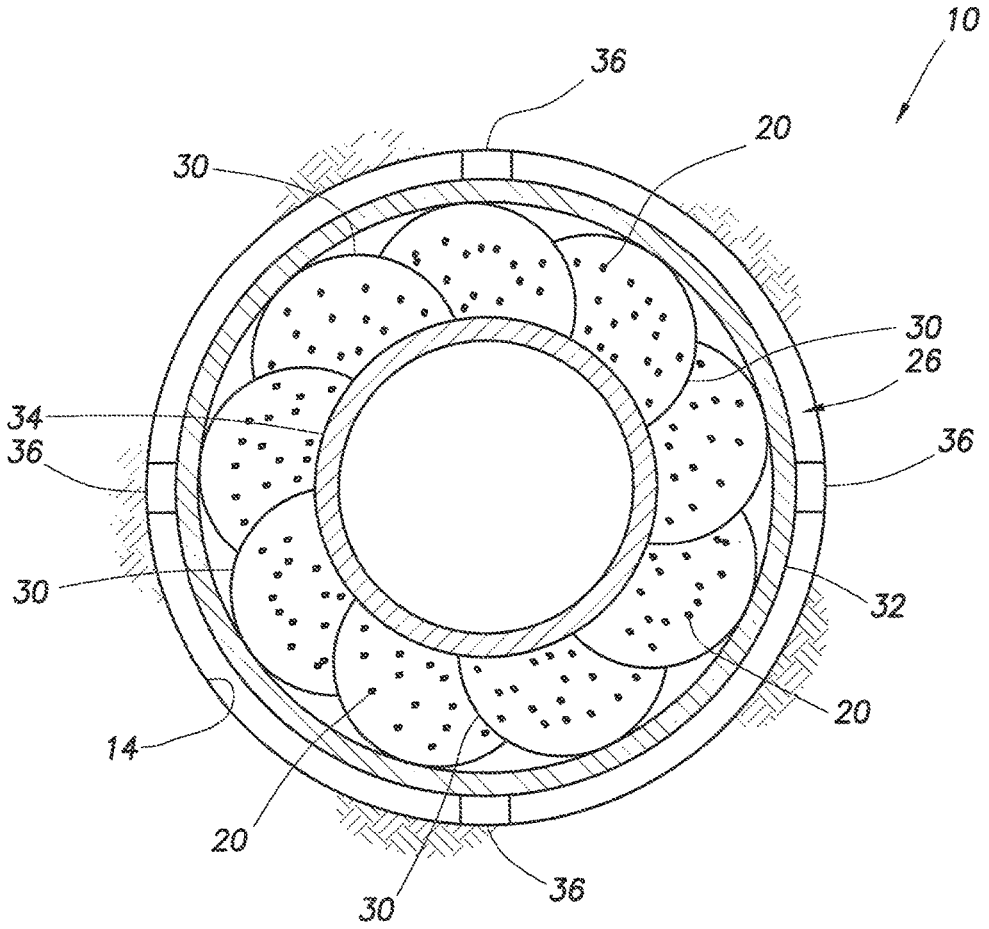
FIG. 2 is a representative cross-sectional view of a drilling tool which may be used in the system and method of FIG. 1, and which can embody the principles of this disclosure.

Referring additionally now to FIG. 2, a representative cross-sectional view of the drilling tool 26 is representatively illustrated. In this view, it may be seen that the tool 26 includes multiple cutters or blades 30 positioned between a generally tubular outer housing 32 and a generally tubular inner mandrel 34.

If the drill string 12 rotates during drilling, then the inner mandrel 34 may rotate with the drill string, thereby causing the blades 30 to rotate, also. Thus, as the drill cuttings 20 flow between the outer housing 32 and the inner mandrel 34, the blades 30 chop the drill cuttings 20 into progressively finer particles.

The outer housing 32 may be restricted or prevented from rotating relative to the borehole 14 by one or more outwardly extendable gripping devices 36. Note that it is not necessary for the inner mandrel 34 to rotate relative to the outer housing 32, or for the drill string 12 to rotate at all, and in other examples the outer housing could rotate relative to the inner mandrel. Thus, the scope of this disclosure is not limited to any particular details of the drilling tool 26 as depicted in FIG. 2 and/or described herein.

The blades 30 are just one example of a wide variety of different devices which can be used to reduce the size of the drill cuttings 20. For example, the devices could instead comprise rollers to break up or pulverize the drill cuttings 20.

Figure 3:
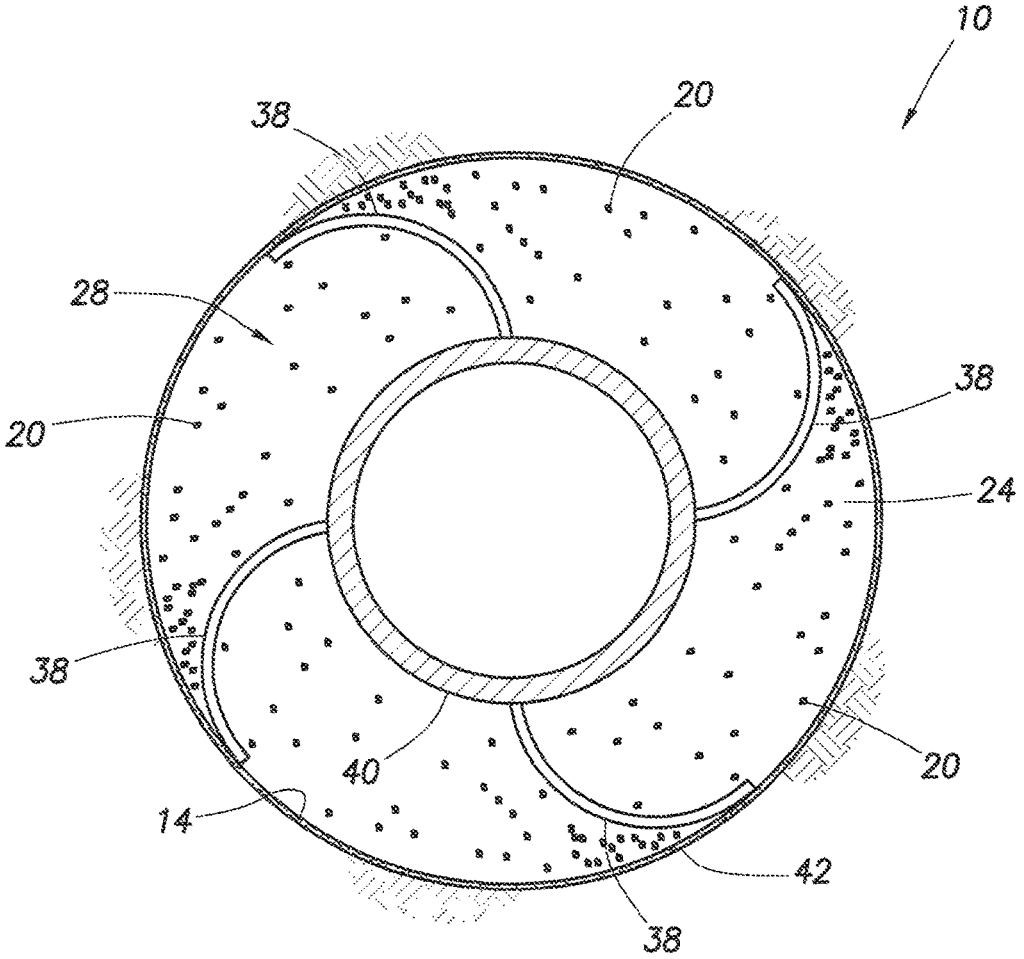
FIG. 3 is a representative cross-sectional view of another drilling tool which may be used with the drilling tool of FIG. 2.

Referring additionally now to FIG. 3, a cross-sectional view of the drilling tool 28 is representatively illustrated. In this view, it may be seen that the tool 28 includes multiple flaps 38 which extend outwardly from a generally tubular mandrel 40.

The flaps 38 may be biased by centrifugal force into contact with the wall of the borehole 14. In this manner, the flaps 38 can be used to force the diminished drill cuttings 20 against the wall of the borehole 14, thereby forming a relatively stable and impermeable layer 42 on the borehole wall.

In other examples, the flaps 38 or pads, etc. could be extended outward and retracted inward by actuators or other means. Thus, it will be appreciated that the scope of this disclosure is not limited to any particular features of the drilling tool 28 depicted in the drawings and/or described herein.

Figure 4:
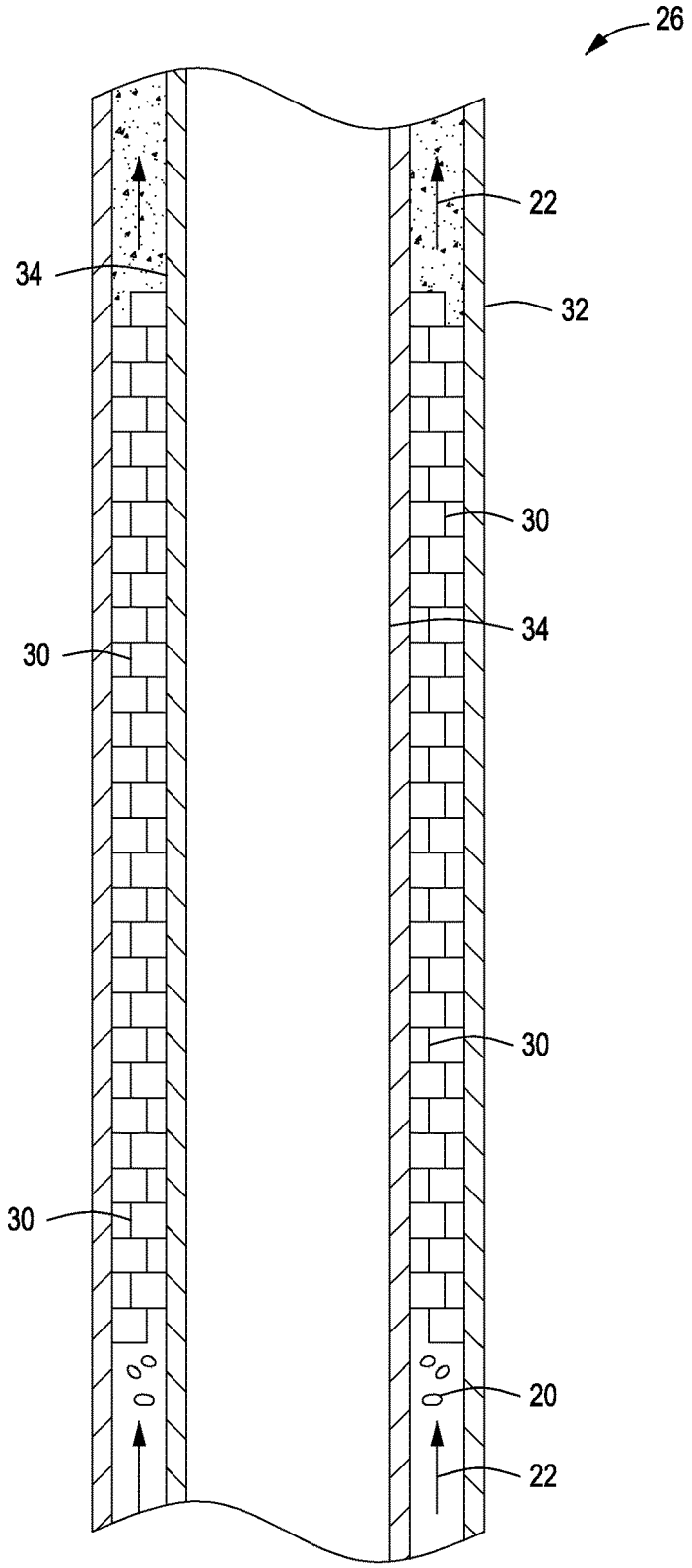
FIG. 4 is a representative cross-sectional view of another example of the drilling tool of FIG. 2.

Referring additionally now to FIG. 4, another example of the drilling tool 26 is representatively illustrated. In this example, the blades 30 are in the form of generally rectangular blocks secured to or integrally formed with the outer housing 32 and inner mandrel 34. As the drilling fluid 22 and drill cuttings 20 flow between the outer housing 32 and inner mandrel 34, the blades 30 passing by each other chops the drill cuttings into progressively finer particles.

Figure 5:
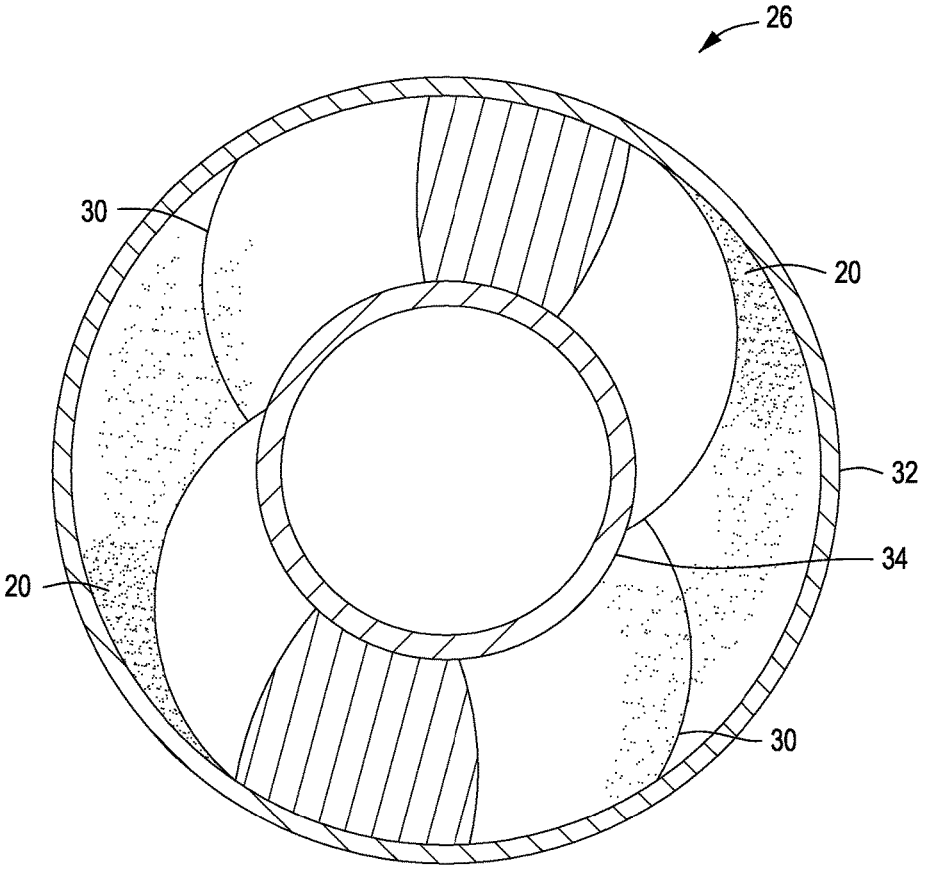
FIG. 5 is a representative cross-sectional view of yet another example of the drilling tool of FIG. 2.

Referring additionally now to FIG. 5, another example of the drilling tool 26 is representatively illustrated. In this example, the blades 30 extend spirally on the inner mandrel 34. The blades 30 are shaped so that the drill cuttings 20 are crushed or pulverized in a tight annular space between the spiral blades 30 and the outer housing 32. Of course, spiral blades could be provided on the outer housing 32 in other examples.

It may now be fully appreciated that the above disclosure provides significant advancements to the art of drilling boreholes. In the system 10 described above, the drill cuttings 20 can be conditioned by the drilling tool 26 prior to being forced against the wall of the borehole 14 by the drilling tool 28. This can provide a substantially improved plastering effect in the drilling operation.

A method of drilling a borehole 14 is described above. In one example, the method can comprise chopping drill cuttings 20 with a first drilling tool 26 connected in a drill string 12, the first drilling tool 26 receiving the drill cuttings 20 from a drill bit 18; and then forcing the chopped drill cuttings 20 against a wall of the borehole 14.

The chopping step can include chopping the drill cuttings 20 with at least one blade 30 of the first drilling tool 26. The blade 30 may be positioned between an outer housing 32 and an inner mandrel 34 of the first drilling tool 26.

The method can include restricting relative rotation between the outer housing 32 and the borehole 14.

The drill cuttings forcing step can include extending flaps 38 outward from a mandrel 40 of a second drilling tool 28 connected in the drill string 12. The extending step may include centrifugal force biasing the flaps 38 outward.

The first drilling tool 26 may be connected in the drill string 12 between the drill bit 18 and the second drilling tool 28.

A well drilling system 10 is also described above. In one example, the system 10 can include a first drilling tool 26 which chops drill cuttings 20, and a second drilling tool 28 which forces the chopped drill cuttings 20 against a borehole 14 wall.

Another method of drilling a borehole 14 can comprise chopping drill cuttings 20 with a first drilling tool 26 connected in a drill string 12; and then forcing the chopped drill cuttings 20 against a wall of the borehole 14 with a second drilling tool 28 connected in the drill string 12.

Another well drilling system 10 can comprise a drilling tool 26 connected in a drill string 12, the drilling tool 26 including an outer housing 32, an inner mandrel 34, and at least one device (such as blades 30, rollers, etc.) which decreases an average size of drill cuttings 20 between the outer housing 32 and the inner mandrel 34.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well drilling system for drilling a borehole having a wall, comprising:

a first drilling tool connected in a drill string, the first drilling tool including:

an outer housing, an inner mandrel, and a blade coupled to the inner mandrel and positioned in an annular cavity formed between the outer housing and the inner mandrel, and configured to decrease an average size of drill cuttings to produce diminished drill cuttings; and a second drilling tool connected in the drill string, the second drilling tool comprising a tubular mandrel and flaps extendable outwardly from the tubular mandrel.

2. The well drilling system of claim 1, wherein the first drilling tool receives the drill cuttings from a drill bit.

3. The well drilling system of claim 1, wherein the blade chops the drill cuttings.

4. The well drilling system of claim 1, the flaps are configured to force the diminished drill cuttings against the borehole wall.

5. The well drilling system of claim 4, wherein the first drilling tool is positioned between a drill bit and the second drilling tool.

6. The well drilling system of claim 1, wherein the blade pulverizes the drill cuttings.

7. The well drilling system of claim 1, wherein the second drilling tool is configured to be rotated in the borehole such so as to create a centrifugal force that biases the flaps outwardly.

8. The well drilling system of claim 1, further comprising at least one gripping device which restricts relative rotation between the outer housing and a borehole.

9. A method of drilling a borehole, comprising:

flowing drill cuttings from a drill bit to a first drilling tool connected in a drill string within the borehole, wherein the first drilling tool comprises:

an outer housing, an inner mandrel, and a blade coupled to the inner mandrel and positioned in an annular cavity formed between the outer housing and the inner mandrel;

chopping the drill cuttings with the blade of the first drilling tool to produce chopped drill cuttings; and forcing the chopped drill cuttings against a wall of the borehole by extending flaps outwardly from a tubular mandrel of a second drilling tool connected in the drill string.

10. The method of claim 9, further comprising restricting relative rotation between the outer housing and the borehole.

11. The method of claim 9, wherein the extending further comprises centrifugal force biasing the flaps outward.

12. The method of claim 9, wherein the first drilling tool is connected in the drill string between the drill bit and the second drilling tool.

13. The method of claim 9, further comprising retracting the flaps inwardly toward the tubular mandrel.

14. The method of claim 13, further comprising actuators configured to extend the flaps outwardly and retract the flaps inwardly.

15. A well drilling system for drilling a borehole having a wall, comprising:

a drill string positionable within the borehole;

a first drilling tool connected to the drill string and configured to chop drill cuttings, the first drilling tool including:

an outer housing, an inner mandrel, and a blade coupled to the inner mandrel and positioned in an annular cavity formed between the outer housing and the inner mandrel, the blade configured to chip the drill cuttings; and a second drilling tool connected to the drill string and configured to force the chopped drill cuttings against the borehole wall, the second drilling tool including flaps extendable outwardly and retractable inwardly by an actuator.

16. The well drilling system of claim 15, wherein the first drilling tool is positioned between a drill bit and the second drilling tool.

17. The well drilling system of claim 15, wherein the first drilling tool is configured to receive the drill cuttings from a drill bit.

18. The well drilling system of claim 15, wherein centrifugal force biases the flaps outwardly.

19. The well drilling system of claim 15, further comprising at least one gripping device which restricts relative rotation between the outer housing and the borehole.

20. A method of drilling a borehole having a wall, comprising:

flowing drill cuttings from a drill bit to a first drilling tool connected in a drill string within the borehole, the first drilling tool including:

an outer housing, an inner mandrel, and a blade coupled to the inner mandrel and positioned in an annular cavity formed between the outer housing and the inner mandrel;

chopping drill cuttings with the blade of the first drilling tool to produce chopped drill cuttings; and forcing the chopped drill cuttings against the borehole wall with a second drilling tool connected in the drill string.

21. The method of claim 20, wherein the first drilling tool is connected in the drill string between the drill bit and the second drilling tool.

22. The method of claim 20, wherein the forcing further comprises extending flaps outwardly from a tubular mandrel of the second drilling tool.

23. The method of claim 22, wherein the extending further comprises centrifugal force biasing the flaps outwardly.

24. The method of claim 22, further comprising retracting the flaps inwardly toward the tubular mandrel.

25. The method of claim 24, further comprising actuators configured to extend the flaps outwardly and retract the flaps inwardly.

26. The method of claim 20, further comprising restricting relative rotation between the outer housing and the borehole.

* * * * *